United States Patent [19]

Sakamaki et al.

[11] 4,163,635

[45] Aug. 7, 1979

[54] VANE TYPE ROTARY FLUID PUMPS OR COMPRESSORS

[75] Inventors: Hiroshi Sakamaki, Utsunomiya; Toshiyuki Maeda, Ageo; Toshimitsu Sakai, Okazaki; Tadashi Saitou, Toyota, all of Japan

[73] Assignees: Nippon Piston Ring Kabushiki Kaisha, Tokyo; Toyota Jidosha Kogyo Kabushiki Kaisha, Toyota, both of Japan

[21] Appl. No.: 803,272

[22] Filed: Jun. 3, 1977

Related U.S. Application Data

[63] Continuation of Ser. No. 663,343, Mar. 6, 1976, abandoned.

[30] Foreign Application Priority Data

Jun. 24, 1975 [JP] Japan ..... 50-87809[U]

[51] Int. Cl.[2] ..... F01C 1/00; F01C 21/00; F04C 17/00; F04C 29/00

[52] U.S. Cl. ..... 418/236

[58] Field of Search ..... 418/236, 238, 259

[56] References Cited

U.S. PATENT DOCUMENTS

| | | | |
|---|---|---|---|
| 1,321,706 | 11/1919 | Bosch | 418/238 |
| 1,543,155 | 6/1925 | Fradet | 418/83 |
| 2,839,007 | 6/1958 | Benedek | 418/236 |
| 3,272,139 | 9/1966 | Rosaen | 418/238 |

FOREIGN PATENT DOCUMENTS

| | | | |
|---|---|---|---|
| 171677 | 6/1906 | Fed. Rep. of Germany | 418/238 |

*Primary Examiner*—John J. Vrablik

*Attorney, Agent, or Firm*—Stevens, Davis, Miller & Mosher

[57] ABSTRACT

In a vane type rotary fluid pump or compressor, a plurality of vanes are slidably fitted in the body of a rotor at an angle with a radial plane passing through the axial center line of the rotor to move radially outwardly from the rotor in a direction opposite to the direction of rotation of the rotor. Each tip of the vanes is provided with a flat surface frictionally guided by a cylindrical inner wall of a stator housing and a taper surface extending from the front end of the flat surface toward the direction of rotation of the rotor. The flat surface of the vane has a predetermined width sealingly in contact with the inner wall of the stator housing.

1 Claim, 5 Drawing Figures

VANE TYPE ROTARY FLUID PUMPS OR COMPRESSORS

This a continuation of application Ser. No. 663,343 filed Mar. 6, 1976, now abandoned.

BACKGROUND OF THE INVENTION

The present invention relates to a rotary fluid pump or compressor, and more particularly to an improved vane type rotary fluid pump or compressor in which a rotor is eccentrically journalled within a stator housing and a plurality of vanes are slidably fitted in the body of the rotor at an angle with a radial plane passing through the axial center line of the rotor.

In a vane type rotary fluid pump or compressor of this kind, a plurality of vanes slidably fitted in the body of a rotor are frictionally guided at their tips by a cylindrical inner wall of a stator housing to form suction, compression and delivery chambers and function to seal each of the chambers from each other. It is, therefore, preferable that each tip of the vanes is formed to have a curved sliding face corresponding with the inner wall of the stator housing. However, formation of the curved sliding face is very difficult in manufacturing process and causes high production cost. Conventionally, a solution of the problems has been proposed, wherein a round-shaped sliding tip is provided to the vane. The result is not sufficient since the initial fitness of the vane to the inner wall of the stator housing is yet rather poor and the sealing function is not satisfactory.

SUMMARY OF THE INVENTION

The primary object of the present invention is to provide an improved vane type rotary fluid pump or compressor, wherein good initial fitness of the vane to the inner wall of the stator housing and good sealing effect by the vane are ensured.

According to the present invention there is provided an improved vane type rotary fluid pump or compressor wherein a plurality of vanes are slidably fitted in the body of a rotor at an angle with a radial plane passing through the axial center line of the rotor to move radially outwardly from the rotor in a direction opposite to the direction of rotation of the rotor and wherein each of the vanes is provided at its tip with a flat surface frictionally guided by the inner wall of a stator housing and a taper surface extending from the front end of the flat surface toward the direction of rotation of the rotor, the flat surface being perpendicular to the back face of the vane and having a predetermined width sealingly in contact with the inner wall of the stator housing.

BRIEF DESCRIPTION OF THE DRAWINGS

Additional objects and advantages of the present invention will be more readily apparent from the following detailed description of a preferred embodiment thereof when taken together with the accompanying drawings in which.

DESCRIPTION OF THE PREFERRED EMBODIMENT

Figure 1:
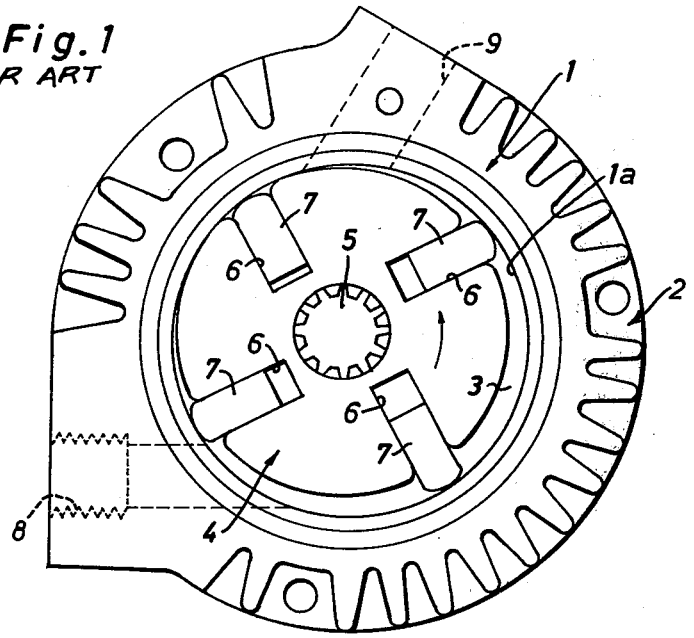
Fig. 1 PRIOR ART
FIG. 1 illustrates an end face of a vane type rotary fluid pump, showing a rotor eccentrically journalled within a cylindrical pump cavity and a plurality of vanes fitted in the body of the rotor.

Referring now to the drawings, in FIG. 1 there is illustrated a vane type rotary fluid pump which comprises a stator housing 1 having a cylindrical inner wall 1*a* and a pair of end heads 2 hermetically clamped on the opposite ends of the stator housing 1 to form a cylindrical pump cavity 3. Within the pump cavity 3, a drive shaft 5 is journalled eccentrically to the axis of the pump cavity and a rotor 4 is fixed to the drive shaft 5. The rotor 4 is provided thereon with a plurality of slots 6 in which a plurality of conventional vanes 7 are slidably fitted to move radially outwardly from the rotor 4 by centrifugal force. During rotation of the pump, the vanes 7 are frictionally guided at their tips by the inner wall 1*a* of the stator housing 1 to form suction, compression and delivery chambers therebetween so that fluid is sucked into the suction chamber through an inlet port 8, then compressed in the compression chamber and subsequently discharged from the delivery chamber through an outlet port 9.

Figure 2:
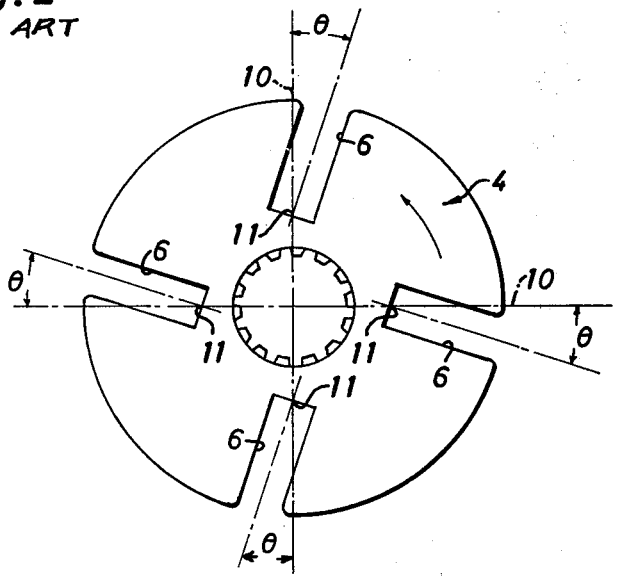
Fig. 2 PRIOR ART
FIG. 2 illustrates an end face of the rotor shown in FIG. 1.
Figure 3:
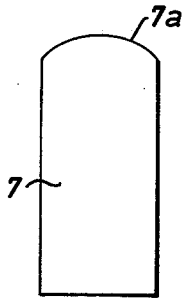
Fig. 3 PRIOR ART
FIG. 3 illustrates an end face of a conventional vane.

As shown in FIG. 2, each of the rotor slots 6 makes an angle $\theta$ with a radial plane 10 defined by the axial center line of the rotor 4 and an axial line 11 at the center in width of the bottom of the slot 6 and extends in a direction opposite to the direction of rotation of the rotor 4. FIG. 3 illustrates one of the conventional vanes 7 of which the tip 7*a* is designed to have a round-shaped sliding face for frictional engagement with the inner wall 1*a* of the stator housing 1. With the rotary fluid pump embodying the conventional vanes 7, there have been drawbacks that the initial fitness of the vanes 7 against the inner wall 1*a* of the stator housing 1 is poor and volumetric efficiency of the pump is reduced because a linear contact can only be obtainable between the tip 7*a* of the vane 7 and the inner wall 1*a* of the stator housing 1.

Figure 4:
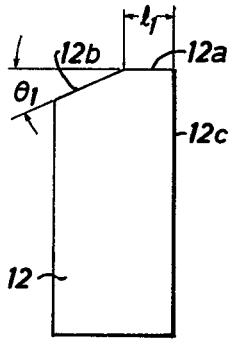
FIG. 4 illustrates an end face of an improved vane in accordance with the present invention.
Figure 5:
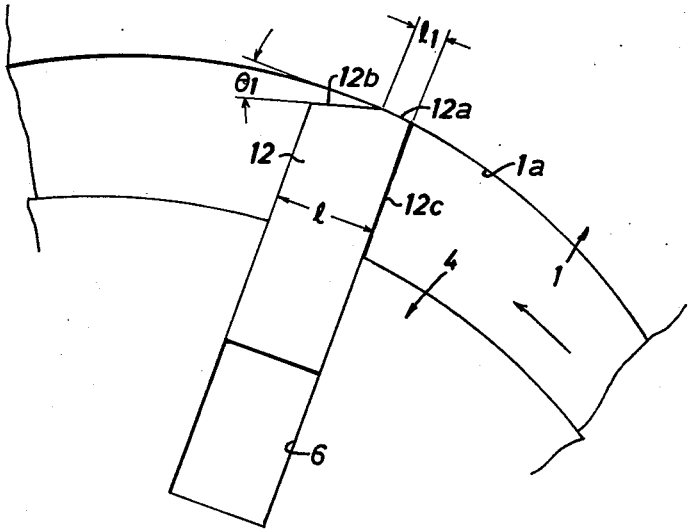
FIG. 5 is a partially enlarged view to show the assembling condition of the improved vane of FIG. 4.

FIG. 4 illustrates an improved vane 12 in accordance with the present invention. This improved vane 12 is provided at its tip with a flat surface 12*a* and a taper surface 12*b* so that the tip of the vane 12 will essentially correspond with the continuous differentiated segments of the cylindrical inner wall 1*a* of the stator housing 1. The flat surface 12*a* makes a right angle with the back face 12*c* of the vane 12 and is positioned at the rear side of the vane 12 when the vane 12 is fitted in the slot 6 of the rotor, as shown in FIG. 5. Assuming that the thickness l of the vane 12 is 3 mm to 5 mm, the width $l_1$ of the flat surface 12*a* should be determined in a range of 3/10 mm to 5/2 mm. Thus, as shown in FIG. 5, the flat surface 12*a* of the vane 12 provides a face contact between the tip of the vane 12 and the inner wall of the stator housing 1 to increase sealing effect of the vane 12. Moreover, assuming that the thickness of the vane 12 is generally indicated with the character l, when the width $l_1$ of the flat surface 12*a* is smaller than l/10, good sealing effect cannot be obtained due to insufficient contact of the flat surface 12*a* with the inner wall of the stator housing 1, and when the width $l_1$ is larger than l/2, the initial fitness of the vane 12 to the inner wall of the stator housing 1 becomes worse than in a conventional vane.

When the vane 12 is fitted in the slot 6 of the rotor 4, the taper surface 12*b* is positioned at the front side of the vane 12 and extends from the front end of the flat surface 12a in the direction of rotation of the rotor 4. The taper angle $\theta_1$ of the taper surface 12b to the flat surface 12a should be determined in a range of the slot angle $\theta+5°$ to 10° for the following reason. If the taper angle $\theta_1$ is smaller than $\theta+5°$ or larger than $\theta+10°$, the initial fitness of the vane 12 to the inner wall 1a of the stator housing 1 becomes poor.

Although the present invention has been illustrated and described in connection with a specific embodiment, various adaptations and modifications will become apparent to those skilled in the art from the description in conjunction with the appended claims without departing from the scope and spirit of the present invention.

What is claimed is:

1. In a vane type rotary fluid pump or compressor comprising a stator housing having a cylindrical inner wall, end wall structures to define a pump cavity within said stator housing, a rotor eccentrically rotatably disposed within said pump cavity, and a plurality of vanes slidably disposed in said rotor; the improvement wherein:

each of said vanes has a front and a rear face and extends outwardly from the rotor at an angle relative to a radial plane in which the axial center line of the rotor is disposed and in a direction opposite to the direction of rotation of the rotor, and the radially outermost end of each of said vanes comprises:

a first flat surface in abutment with the inner wall of the stator housing, said first surface being substantially perpendicular to the rear face of said vane, extending from the rear face for a distance of 1/10 to ½ the distance between the front and rear faces of the vane and terminating in a front edge, and a second flat tapered surface extending inwardly from said front edge to said front face at an angle relative to the first surface which is 5° to 10° larger than said first-mentioned angle and terminating at the front face of said vane.

* * * * *